US008985791B1

(12) United States Patent
Hinzmann

(10) Patent No.: US 8,985,791 B1
(45) Date of Patent: Mar. 24, 2015

(54) LIGHT AND BASE

(71) Applicant: Gregory Hinzmann, Portland, OR (US)

(72) Inventor: Gregory Hinzmann, Portland, OR (US)

( * ) Notice: Subject to any disclaimer, the term of this patent is extended or adjusted under 35 U.S.C. 154(b) by 0 days.

(21) Appl. No.: 13/920,067

(22) Filed: Jun. 17, 2013

Related U.S. Application Data

(60) Provisional application No. 61/660,728, filed on Jun. 17, 2012.

(51) Int. Cl.
*F21V 13/02* (2006.01)
*F21V 1/00* (2006.01)
*F21L 4/08* (2006.01)

(52) U.S. Cl.
CPC .. *F21L 15/02* (2013.01); *F21L 4/08* (2013.01)
USPC ..... 362/2

(58) Field of Classification Search
CPC ..... H05B 33/0845; F21V 3/02; F21V 5/007; F21Y 2103/003; F21Y 2105/001; G02B 19/0028; G02B 19/0066
USPC ..... 362/431, 13, 183, 249.02
See application file for complete search history.

(56) References Cited

U.S. PATENT DOCUMENTS

| | | | | |
|---|---|---|---|---|
| RE36,696 | E * | 5/2000 | Blackman | 362/20 |
| 6,227,677 | B1 * | 5/2001 | Willis | 362/196 |
| 6,474,837 | B1 * | 11/2002 | Belliveau | 362/231 |
| 7,938,555 | B1 * | 5/2011 | Kalhofer | 362/183 |
| 2008/0043466 | A1 * | 2/2008 | Chakmakjian et al. | 362/237 |
| 2008/0144310 | A1 * | 6/2008 | Barbeau et al. | 362/183 |
| 2012/0033415 | A1 * | 2/2012 | Sharrah et al. | 362/199 |
| 2012/0147595 | A1 * | 6/2012 | Wang | 362/183 |
| 2012/0201018 | A1 * | 8/2012 | Palmer et al. | 362/183 |

OTHER PUBLICATIONS

Entry for Votive Candle downloaded from http://en.wikipedia.org/wiki/Votive_candle on Jan. 4, 2015.

* cited by examiner

*Primary Examiner* — Tracie Y Green

(57) ABSTRACT

A system may include a housing, a diffuser configured to rotate between two positions, a series of lenses correlating to a series of LED lights, and a base. The diffuser may contain one or more lenses that may be arranged to align with the LED lights allowing light transmission.

1 Claim, 6 Drawing Sheets

LIGHT AND BASE

CROSS-REFERENCE TO RELATED APPLICATIONS

This application claims priority from U.S. Provisional Patent Application No. 61/660,728 filed Jun. 17, 2012 titled Light and Base.

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

BACKGROUND

Flashlights typically provide a directional cone-shaped beam of light projecting from a light source and are intended to be hand-held. A typical flashlight includes an energy source, a light source and a power switch.

Lights typically provide a single source of non-directional light from a fixed or non-portable position and are comprised of a stand, light source and lens.

Emergency lights are typically plugged directly into an electrical outlet and turn on automatically when detecting a loss of power.

DETAILED DESCRIPTION

The inventive principles of this patent disclosure relate to lights and bases, for example, a portable, rechargeable light with three functions and vertical charging position with base.

Figure 1:
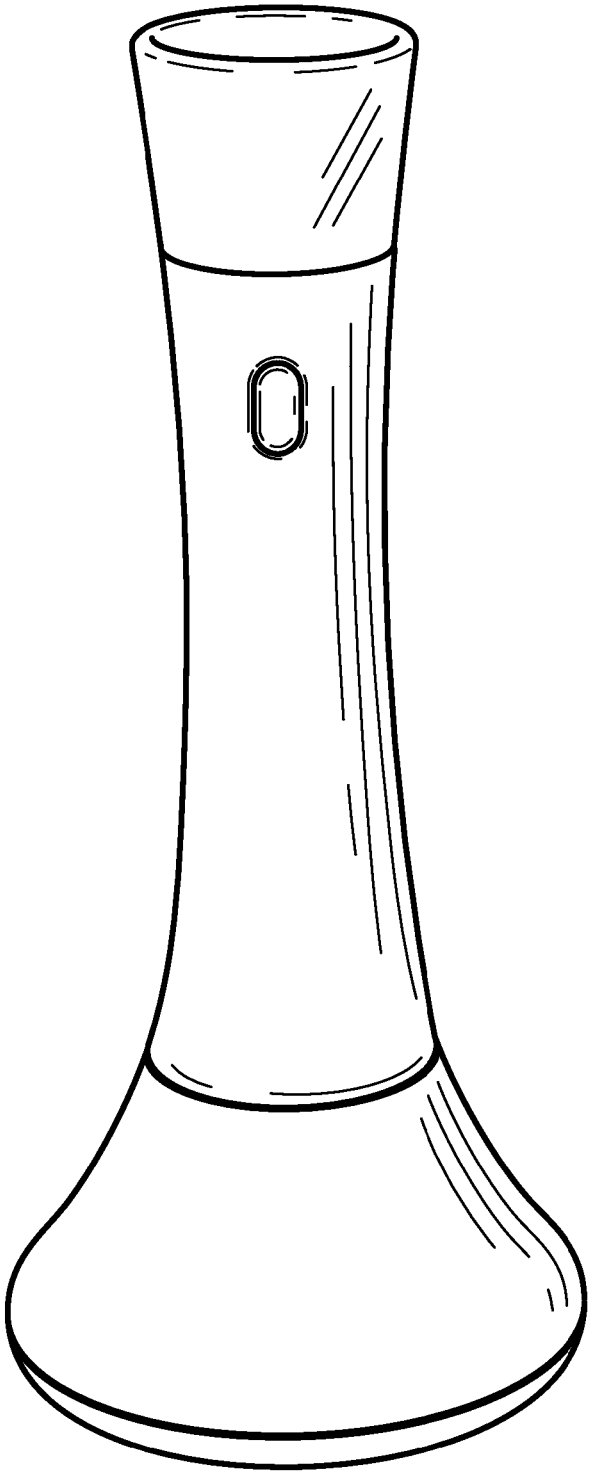
FIGS. 1 through 5 illustrate an example embodiment of a light and base device according to some inventive principles of this patent disclosure.
Figure 2:
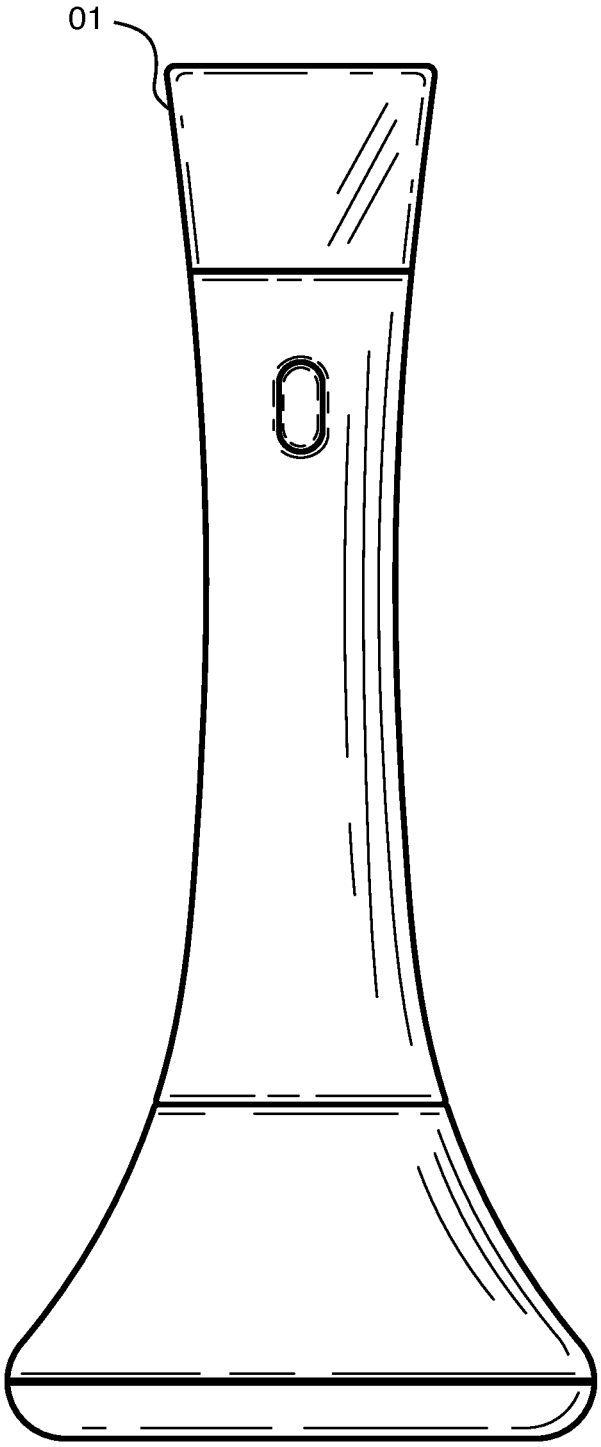
Figure 3:
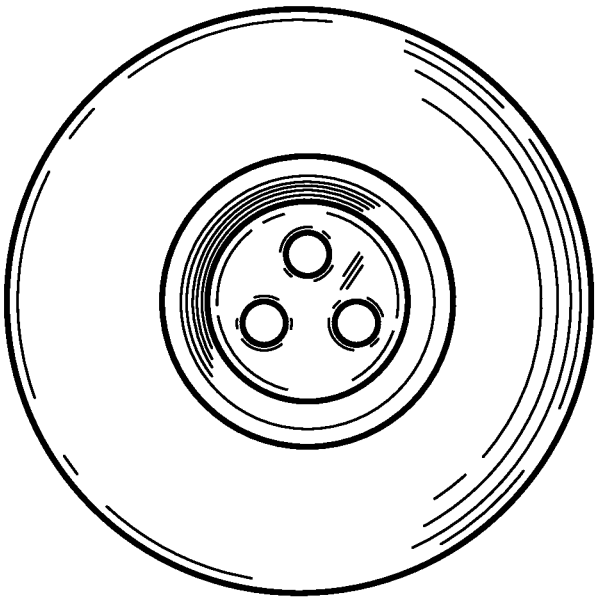

In one embodiment, the system includes a portable, rechargeable light with three functions: flashlight, accent light and emergency light. The light is stored in a vertical position on top of a base shown in FIG. 2 that plugs into an outlet in order to charge the batteries.

Figure 4:
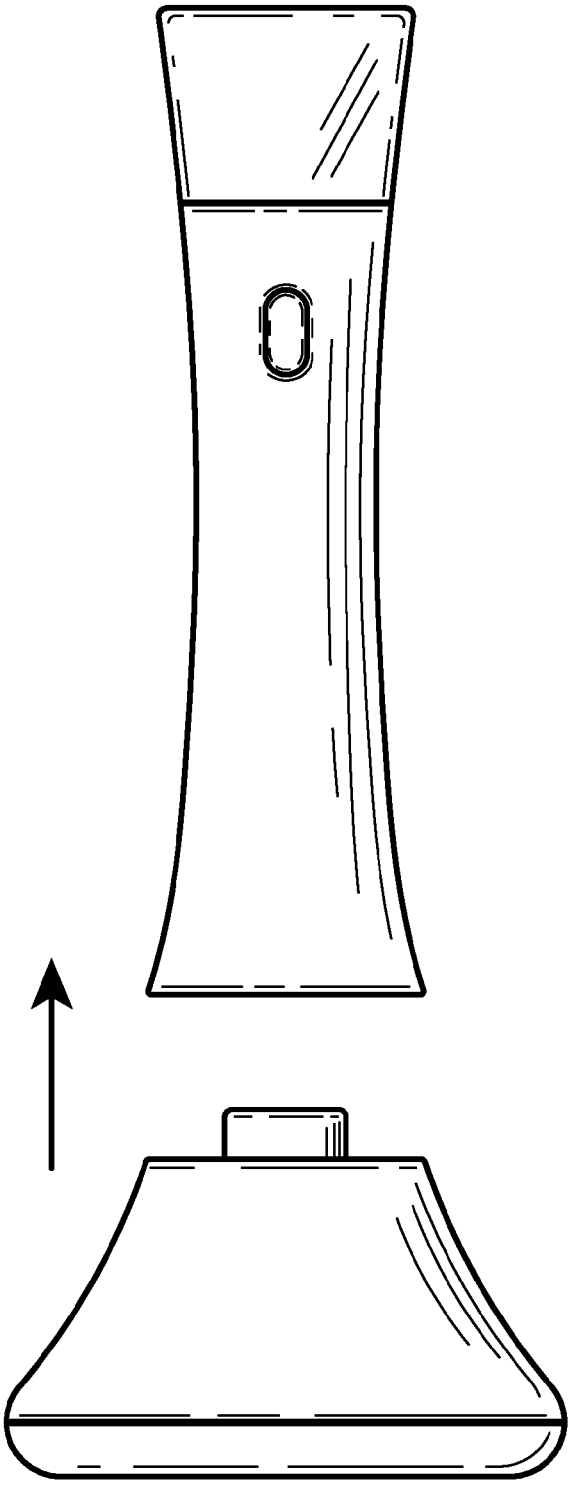

For portability, the product is removed from the base shown in FIG. 4 and held in the hand. The light is automatically turned on when removing the housing from the base and turned off via a single switch. The switch can be used to turn the light on again.

Figure 5:
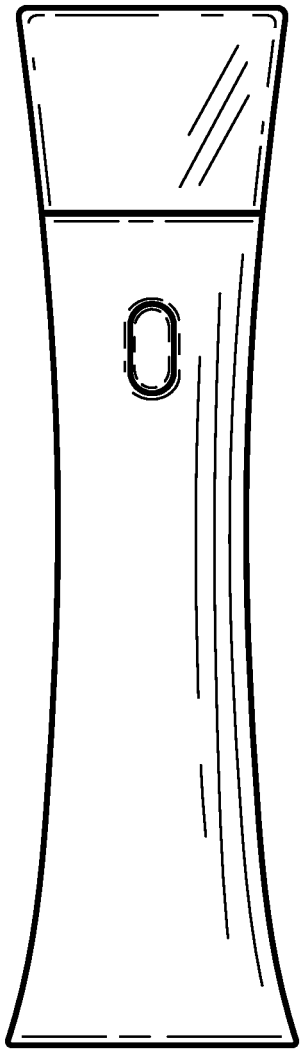

The product is tapered to provide a stable surface allowing the light to stand on its own off the base shown in FIG. 5.

Figure 6:
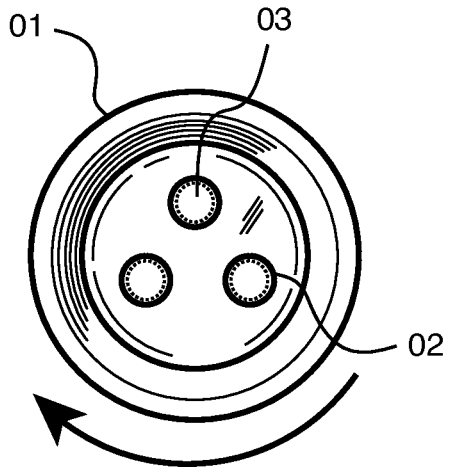
FIGS. 6 and 7 illustrate an example embodiment of a diffuser and lens providing directional light or accent light according to some inventive principles of this patent disclosure.
Figure 7:
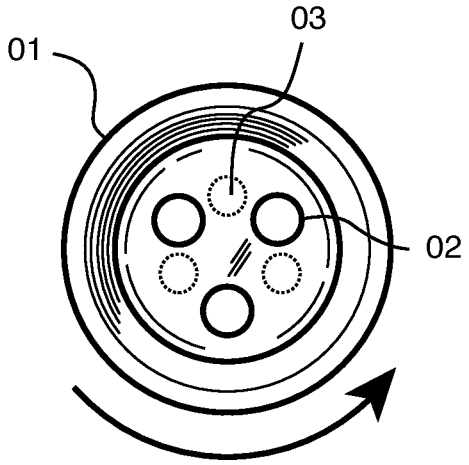

The lens can be used as an accent light, providing indirect light similar to a votive candle, or can be used as a flashlight by turning the diffuser 01 shown in FIG. 6 to align three LED lights 03 with three clear lenses 02 which allows the product to project a beam of light.

The product can be used as an accent light on or off the base. The circuitry allows the product to sense active power current running through the outlet and if power is lost, the product will automatically illuminate.

The inventive principles of this patent disclosure have been described above with reference to some specific example embodiments, but these embodiments can be modified in arrangement and detail without departing from the inventive concepts. Such changes and modifications are considered to fall within the scope of the following claims.

The invention claimed is:

1. A handheld light comprising:

a housing having a generally cylindrical shape with an axis running from a first end of the housing to a second end of the housing;

multiple LED lights at the first end of the housing; and a diffuser having multiple clear lenses at the first end of the housing;

wherein:

the diffuser has a first position in which the clear lenses are aligned with the LED lights to project a directional beam of light in a direction parallel to the axis of the housing, thereby operating as a conventional flashlight, the diffuser has a second position in which the clear lenses are not aligned with the LED lights but instead produces indirect accent lighting by causing light from the LED lights to diffuse outward through the sides of the diffuser in a plane that is perpendicular to (i.e., at a 90 degree angle from) the axis of the housing, thereby simulating candlelight from a votive candle, the diffuser rotates between the first and second positions, the housing includes an enlarged portion at the second end so the housing can stand on its own when the second end of the housing is placed on a horizontal surface, thereby simulating a candlestick with the axis of the housing being perpendicular to the horizontal surface, the housing has a narrow central portion for holding the light by hand, and the second end of the housing is adapted to engage a charging base to recharge the light when the housing is stored on the base with the axis of the housing in a vertical position.

* * * * *